US005621937A

United States Patent [19]

Georgantas

[11] Patent Number: 5,621,937

[45] Date of Patent: Apr. 22, 1997

[54] JET DYEING APPARATUS AND METHOD

[75] Inventor: Aristides Georgantas, Athens, Greece

[73] Assignee: S. Sclavos, S.A., Athens, Greece

[21] Appl. No.: 514,701

[22] Filed: Aug. 14, 1995

Related U.S. Application Data

[63] Continuation-in-part of Ser. No. 222,090, Apr. 4, 1994, Pat. No. 5,440,771.

[51] Int. Cl.[6] ..... D06B 3/24

[52] U.S. Cl. ..... 8/149.3; 8/151; 68/178; 68/177

[58] Field of Search ..... 68/177, 178, 180, 68/175, 176; 8/151, 152

[56] References Cited

U.S. PATENT DOCUMENTS

| | | | |
|---|---|---|---|
| 1,041,031 | 10/1912 | Craig . | |
| 1,074,567 | 9/1913 | Gantt . | |
| 1,665,624 | 4/1928 | Conrad . | |
| 2,228,050 | 1/1941 | Collier | 68/177 |
| 2,403,311 | 7/1946 | Steele | 28/1 |
| 2,579,563 | 12/1951 | Gallinger | 68/5 |
| 3,587,256 | 6/1971 | Spara | 68/177 |
| 3,802,840 | 4/1974 | Chiba et al. | 8/152 |
| 3,949,575 | 4/1976 | Turner et al. | 68/5 |
| 3,982,411 | 9/1976 | Kreitz | 68/177 |
| 4,023,385 | 5/1977 | Hurd | 68/62 |
| 4,041,559 | 8/1977 | von der Eltz | 8/49 |
| 4,142,385 | 3/1979 | Sandberg et al. | 68/178 |
| 4,318,286 | 3/1982 | Sturkey | 68/178 |
| 4,716,744 | 1/1988 | Turner et al. | 68/62 |
| 4,766,743 | 8/1988 | Biancalani et al. | 68/20 |
| 4,803,208 | 2/1989 | Ekstroem | 68/178 |

FOREIGN PATENT DOCUMENTS

| | | |
|---|---|---|
| 7438537 | 11/1974 | France . |
| 2315564 | 1/1977 | France . |
| 2140788 | 2/1973 | Germany . |
| 85085038 | 4/1982 | Japan . |
| 90062336 | 6/1988 | Japan . |
| 2004927 | 9/1977 | United Kingdom . |
| 2031969 | 10/1978 | United Kingdom . |
| WO91/1841 | 11/1991 | WIPO . |

OTHER PUBLICATIONS

Welham, A.C., "Development of More Efficient Textile Rinsing Systems", reprinted from American Dyestuff Reporter, Mar., 1994.

*Primary Examiner*—Frankie L. Stinson
*Attorney, Agent, or Firm*—Bell, Seltzer, Park & Gibson, P.A.

[57] ABSTRACT

An improved jet dyeing apparatus is provided which enables the user to dye either lightweight or relatively heavy weight fabrics in the same apparatus with improved efficiency and product quality. The apparatus includes a fabric plaiting mechanism mounted to the exit end of a transport tube and a downwardly directed outlet nozzle. The outlet nozzle further includes dye liquor bypass means for withdrawing a portion of the dye liquor outside the primary path of travel of the fabric as the fabric is deposited into the liquid treatment chamber of the apparatus and provision is also made for removing a portion of the liquid from the jet dyeing apparatus and for recycling a portion of the liquid to the suction side of the main recirculating pump. By virtue of this arrangement an improved high efficiency rinse cycle is enabled in accordance with the related method which is also disclosed.

11 Claims, 4 Drawing Sheets

TO DRAIN
ADD FRESH WATER
STEAM
CK
P
T
V
101
102
103
104
106
107
108
109
110
111
112
115
125
126
127
128
129
130
140
145
150
155
160
165
170
175
L1
L2
6

JET DYEING APPARATUS AND METHOD

This application is a continuation-in-part of earlier filed application Ser. No. 08/222,090, now U.S. Pat. No. 5,440,771, which was filed on Apr. 4, 1994 and which also relates to the apparatus and method disclosed in European Patent Application No. 91909184.3 (International Publication No. WO 91/18141, U.S. Pat. No. 5,299,339).

BACKGROUND OF THE INVENTION

This invention relates to an improved jet dyeing apparatus for dyeing textile materials which is particularly desirable for use in dyeing textile fabrics in rope form. In apparatuses of this type, the fabric to be treated is continuously circulated through a treatment zone or transport tube in which dye liquor is applied to the fabric under pressure. The pressurized liquor serves a dual function, namely to dye the fabric as well as to impart movement to the fabric rope which is conveyed from the transport tube into a fabric storage chamber. Within the storage chamber, the fabric is submerged in excess dye liquor and moves through this chamber suspended in the liquor until it is removed from the opposite end for conveyance through the transport tube whereupon the cycle is repeated.

As noted, pressurized dye liquor is applied to the fabric in the fabric transport tube. For this purpose, the tube typically includes at least one peripheral liquor sprayer or "P.L.S." which is designed to apply the liquor under pressure to the fabric about its complete circumference. It is particularly desirable to apply the pressurized liquor in a way which enhances the interchange between the dyestuffs and the fabric in order to enhance the uniformity of the dye application to the fabric. In order to dye the fabric successfully, however, it is also necessary that the fabric travel at relatively high speeds through the transport tube, but while still ensuring that the desired level of liquor-fabric interchange occurs.

In order to increase operating speeds, it is customary to utilize relatively high liquor pressures in the peripheral liquor sprayer, for example, in order to enhance fabric throughput and fabric-liquor interchange. Unfortunately, the use of high water pressures often results in damage to the surface of the fabric (i.e., peeling or pitting) and "stitch" deformation. The problem is particularly acute with lightweight fabrics which are more susceptible to damage from the relatively high pressures which means that the fabric finisher must typically either reduce his operating rates or compromise the quality of the resulting dyed products.

Representative jet dyeing machines for dyeing fabrics in continuous rope form are shown, for example, in U.S. Pat. Nos. 3,587,256 (Spara), 3,949,575 (Turner, et al.), 3,982,411 (Kreitz), 4,083,208 (Ekstroem), and 4,318,286 (Sturkey). The art-recognized problems of surface degradation in dye treatments, and with lightweight fabrics in particular, are described in Kreitz and Sturkey. For his part, Kreitz suggests that a plurality of nozzles be utilized of differing construction depending upon the type of fabric to be treated in the jet dyeing apparatus. This increases downtime since the apparatus must be modified each time the weight of the fabric to be treated in the jet dyeing apparatus is changed materially. As an alternative, Sturkey proposes the use of a modified j-box and an elongate liquor transport tube which has a steep upward incline in order to ensure, according to Sturkey, that the treated fabric will be conveyed through the transport tube with relatively reduced surface degradation. The problem in the Sturkey device, however, is that the use of a single liquor sprayer at the inlet in combination with the elongate tube, means that extremely high pressures must be used in order to maintain any reasonable throughput through the jet dyeing machine.

A still further modified jet dyeing apparatus is described in U.S. Pat. No. 4,083,208 to Ekstroem which also recognizes the problem presented by the desire to use the same jet dyeing apparatus for the purpose of dyeing either lightweight or heavier fabrics as well as yarns. Ekstroem suggests the use of a discharge pipe of varying undulated constructions which also requires changes in piping construction depending upon the weight of the fabric to be treated. Furthermore, Ekstroem advocates the use of a perforated region in the undulated pipe for the purpose of reducing the rate of travel in the fabric, ostensibly for the reason of reducing turbulence at the discharge point, but with the result that substantial liquor will be drained from the fabric while it is still in the transport chamber, and with the additional result that the capacity of the apparatus will be unduly restricted.

Additional fabric transporting arrangements are shown in U.S. Pat. Nos. 1,665,624 (Conrad), 2,228,050 (Collier), 2,403,311 (Steele), 3,802,840 (Chiba, et al.), 4,041,559 (Von Der Eltz), 4,142,385 (Sandberg, et al.), 4,766,743 (Biancalani, et al.), and in United Kingdom patent application 2,031,969, French publication no. 2,315,564, and German Offenlegungschrifft 2,140,788 which depicts an apparatus for loading and unloading textile material to be wet treated.

Even where higher throughput rates in the fabric transport tube are achieved, related problems can arise which limit the effective capacity of the jet dyeing apparatus. Specifically, it is customary in dyeing fabrics that the fabric leaving the fabric transport tube is delivered into the storage chamber, which is otherwise referred to as the "j-box" or keir. The apparatus which controls the placement of the fabric within the storage chamber or j-box is typically referred to as the "plaiter". It is customary in plaiting the fabrics to induce the formation of longitudinal folds in the fabric as shown, for example, in U.S. Pat. Nos. 4,318,286 (Sturkey) and in 4,023,385 (Hurd), the latter of which describes an oscillating valve for inducing formation of the folds through the use of air pressure. These arrangements can create problems in the form of entanglement of the fabric in the chamber and are inefficient because the capacity in the storage chamber is under-utilized.

Alternative arrangements for plaiting fabrics in a jet dyeing machine are shown in U.S. Pat. No. 2,579,563 to Gallinger and in United Kingdom patent application 2,004,927 ("Mezzera"). In accordance with the disclosures in these additional references, a plaiting nozzle is oscillated transverse to the direction of travel of the fabric through the fabric transport tube and is also preferably oscillated in a longitudinal direction (using the hood 21 in Mezzera, for example) or by axial movements of the discharge nozzle in accordance with the embodiment shown in FIG. 4 of Mezzera. The transverse and longitudinal action results in a parallelepiped arrangement of the fabric which is said to improve the stability of the stored fabric in the j-box in order to attempt to minimize occurrences of fabric entanglement within the j-box or storage chamber.

A similar problem of the instability of the fabric leading to entanglement also arises from the use of a fabric discharge nozzle of the orientation shown in the Mezzera United Kingdom reference described above since the angle of the discharge nozzle is disposed outwardly in a manner which will inherently deposit the fabric in a generally arcuate pattern as it is placed in the j-box. This stack is inherently unstable and wastes capacity within the storage chamber. Here again, the most significant problems are presented by lightweight fabrics and, as noted above, it is particularly desirable to provide a jet dyeing apparatus which is effective for dyeing both lightweight as well as heavier weight fabrics while maximizing the overall capacity of the apparatus.

It is also desirable in connection with the jet dyeing of fabrics to provide an effective means for rinsing unwanted impurities from the treated textile materials after wet processing in order to obtain optimum results The easiest way to obtain acceptable results is to rinse at a high liquor to goods ratio with many changes in fresh liquor The time associated with draining and then filling the apparatus, however, greatly increases the total cycle time required to complete the dyeing process. Furthermore, the increasing costs associated with water use and related waste water treatment, has created a need for rinsing techniques and apparatuses which are effective at reduced overall water consumption while still providing an efficient and effective rinse cycle.

An added complication arises from the fact that in many cases it is considered undesirable to drain the liquor completely in the first rinsing stage (i e., "drop fill rinsing"). For example, in the exhaust dyeing of cellulosic fibers with sulfur dyes, the dye is exhausted onto the fibers from a strongly reducing alkaline liquor Subsequently the dye is oxidized on the fiber to render the dye insoluble in water. In order to prevent localized premature oxidation, the reduction potential of the liquor and the concentration of alkaline must be reduced gradually and evenly as the dye concentration is reduced The use of drop fill rinsing can cause "bronzing" as a result of the migration of dye to the surface and oxidation on the fiber surface instead of within the interstices of the fiber structure Therefore, a technique known as "overflow rinsing" must be utilized in connection with this and other dyeing techniques. Unfortunately, overflow rinsing involving the introduction of large volumes of fresh water is also inefficient in terms of water consumption and time.

The problems associated with the prior art dyeing apparatuses in terms of increasing throughout and improving the quality of the resulting dyed fabrics have been largely overcome by the apparatus and method disclosed in prior European Application No. 91909184.3 (U.S. Pat. No. 5,299,339), the disclosure of which is incorporated herein by reference. In accordance with the teachings of this patent, an improved jet dyeing apparatus is provided which includes a plurality of peripheral liquor sprayers and a preferred design for a liquid transport tube which improves dyeing efficiency. In addition, a unique plaiter design is also disclosed which reduces instances of fabric entanglement in the jet dyeing apparatus. Despite the substantial improvements in efficiency and quality which may be achieved through the use of this apparatus, the need remains for an apparatus and method which provides suitable rinsing efficiencies while at the same time reducing the overall time required to complete the dyeing process.

SUMMARY OF THE INVENTION

In accordance with the present invention, a jet dyeing apparatus of the type which includes a housing having a liquid treatment chamber positioned in the lower portion of the housing which has an upwardly open inlet and an upwardly open outlet is provided. The apparatus also includes a fabric transport tube in the housing positioned above the liquid treatment chamber which comprises an elongate tubular member which defines a generally horizontal centerline which has an exit end for mounting a plaiting apparatus. A plaiting apparatus is also included and is mounted on the exit end of the transport tube for relative rotation about its centerline and which includes a downwardly directed outlet nozzle which overlies the inlet to the liquid treatment chamber. The plaiting member is preferably oscillated about the centerline of the fabric transport tube so that the downwardly directed nozzle reciprocates along a generally linear path of travel which is transverse to the centerline of the transport tube such that fabric passing through the tube is deposited in overlying relatively straight folds in the chamber to maximize capacity and improve the stability of the fabric entering the storage chamber.

The discharge nozzle includes an excess liquor bypass which is preferably integrally formed with the outlet nozzle. In addition, the excess liquor bypass is preferably formed on the outer curve of the elbow defining the outlet nozzle and adjacent the defined path of travel for the fabric. Accordingly, under prevailing operating pressures, a portion of the dyeing liquor may be diverted through the perforated plate in the outlet nozzle and follows a distinct path of travel separated from the fabric into a trough.

In accordance with the present invention, the trough is in fluid communicating relationship with a drain/header line which removes a portion of the liquor flowing into the trough from the interior of the liquid treatment chamber. The liquor flowing through the drain/header line is then recycled to the inlet end of the main recirculating pump, which pumps the dye liquor to the peripheral liquor sprayers for application to the fabric. The drain/header line is, in turn, equipped with variable control valves to control the rate of flow to the inlet side of the recirculating pump or, alternatively (or simultaneously), to direct a portion of the flow to a drain.

In addition, a fresh water inlet is provided adjacent the main recirculating pump which is also equipped with a variable control valve so that fresh water may be added directly to the recirculating liquor. In this manner, fresh water may be introduced, particularly during the rinsing cycle, and a portion of the contaminated wash liquid may be correspondingly removed through the excess liquor bypass to the drain/header line outside the main path of travel of the fabric as it is deposited in the storage chamber. Thus, a portion of the most contaminated liquor (i.e. early in the rinse cycle) may be removed by opening the drain control valve. Furthermore, by opening the valve from the drain/header line to the inlet side of the pump, a suitable head may be maintained to avoid pump cavitation even where the liquor level in the storage chamber is maintained at a relatively low level to further enhance the efficiency of the rinse cycle.

Through the use of the apparatus as disclosed herein and the related method, substantial reductions in the overall cycle time required to achieve satisfactory dyeing may be accomplished since the times required for completely draining and filling the apparatus during the rinse cycle may be eliminated.

BRIEF DESCRIPTION OF THE DRAWINGS

Additional features of the invention will be described hereinbelow in conjunction with the accompanying drawings in which.

DESCRIPTION OF THE PREFERRED EMBODIMENTS

Figure 1:
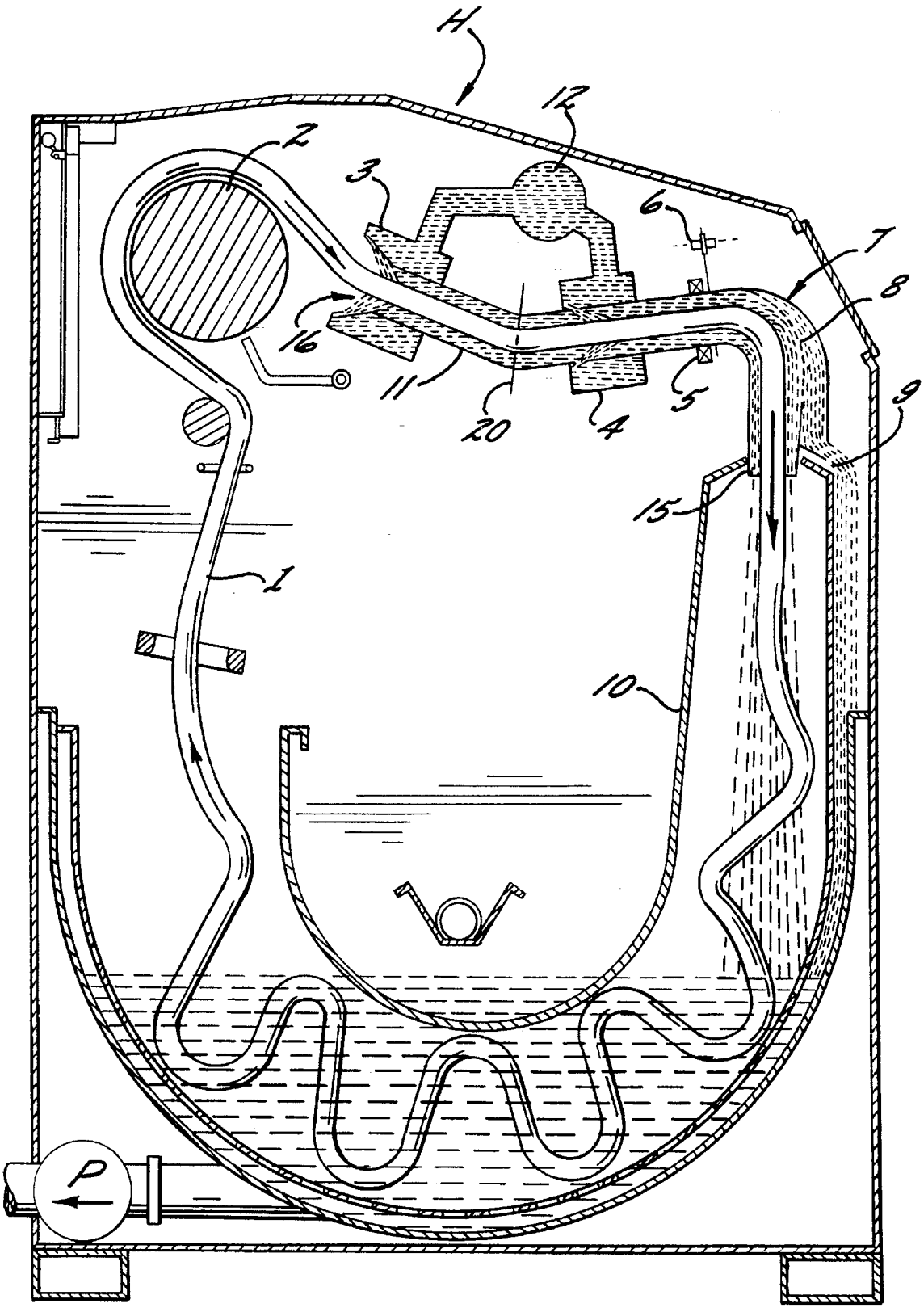
FIG. 1 is a side schematic view showing the general arrangement of the fabric transport tube and particularly in relation to the j-box or liquid treatment chamber in accordance with the applicant's prior invention.
Figure 2:
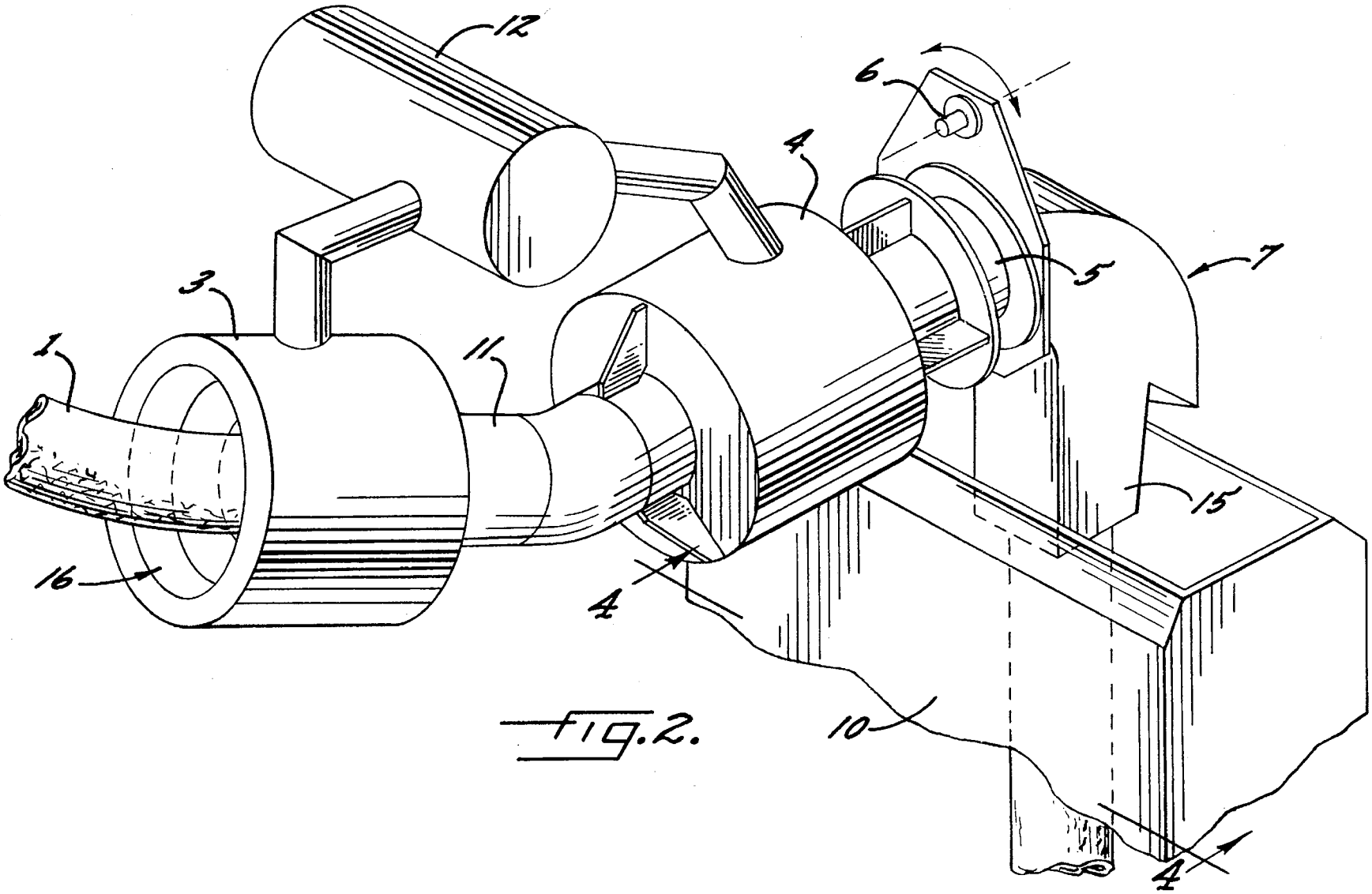
FIG. 2 is a side perspective view which particularly depicts the fabric transport tube and the plaiting mechanism which may be used in accordance with this invention to deposit the fabric in an orderly way within the liquid treatment chamber and also depicting the preferred rectangular design of the outlet nozzle.

As shown in schematic form in FIG. 1 a jet dyeing apparatus in accordance with applicant's prior invention (and as to which most aspects are also applicable to the present invention as explained further hereinbelow) comprises a housing H which includes a liquid treatment chamber or j-box 10 in the lower portion of the housing and a fabric transport tube 11 in the housing above the liquid treatment chamber. In use, the fabric 1 enters the fabric transport tube 11 with the assistance of a driven rotating cylinder 2 as is customary in jet dyeing apparatuses of this general type.

The fabric enters the fabric transport tube 11 at a fabric inlet or entry end 16 and is immediately contacted with liquor from a jet apparatus or peripheral liquor sprayer 3 which is supplied with liquor from a common supply or header 12. The preferred peripheral liquor sprayer sprays liquor on the fabric in a manner which both dyes the fabric and which also serves to transport the fabric 1, which is typically in continuous rope form, along the longitudinal direction of the fabric transport tube 11 and ultimately to the plaiter mechanism 7. During the dyeing process, excess liquor in the treatment chamber is recirculated to the header 12 by recirculating pump P.

The fabric transport tube 11 preferably includes a plurality of peripheral liquor sprayers including the first aforementioned sprayer 3 at the inlet or entry end 16 to the fabric transport tube 11 and a second peripheral liquor sprayer 4. The two peripheral sprayers are preferably supplied by a common header 12. In accordance with the preferred arrangement shown in FIG. 3, the second peripheral liquor sprayer 4 is preferably positioned downstream of the first peripheral liquor sprayer 3 and closely adjacent the midpoint 20 of the fabric transport tube 11. As shown, the nozzle of the second peripheral liquor sprayer 4 is spaced approximately 135 mm from the approximate midpoint 20.

Figures 3, 4:
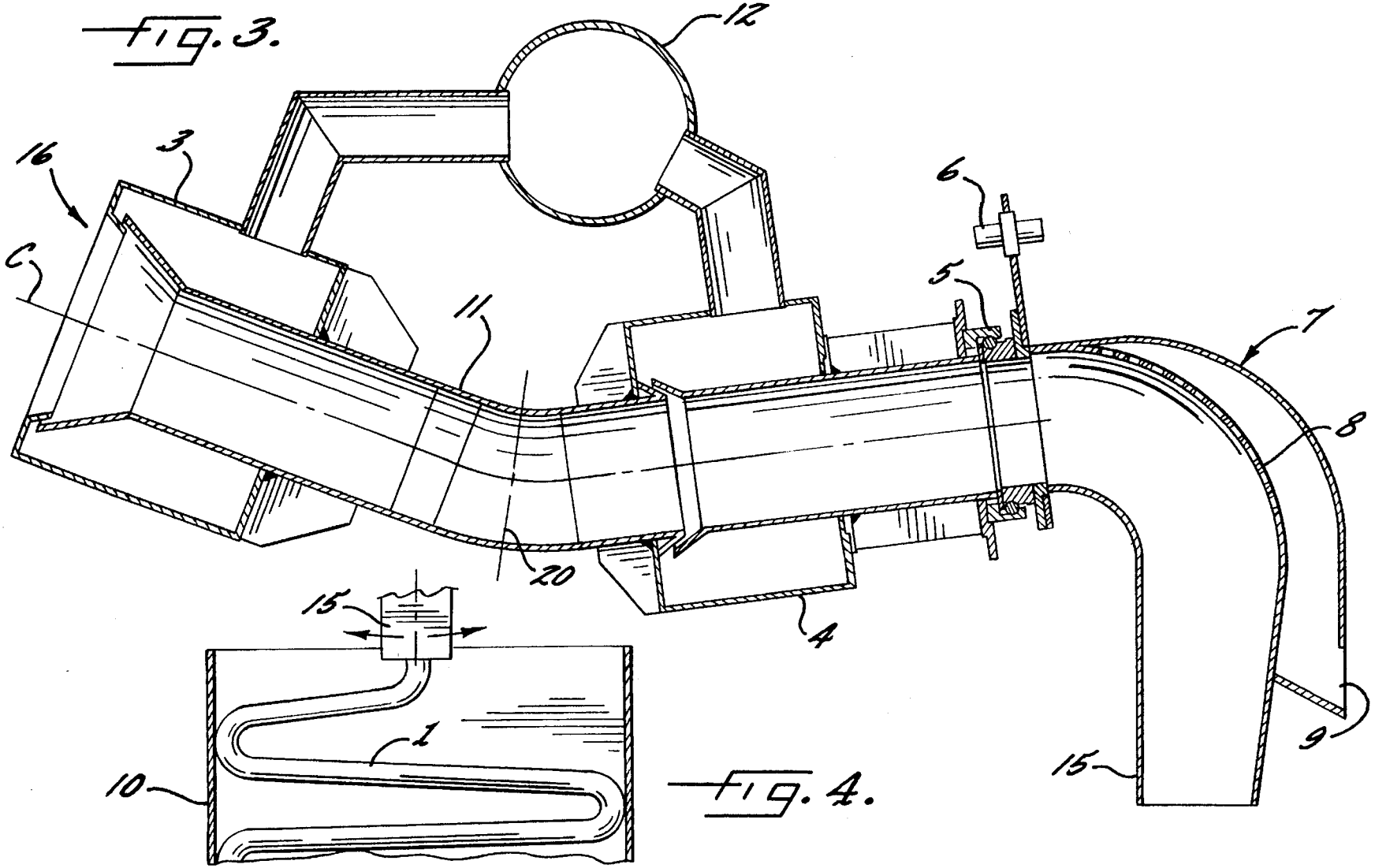
FIG. 3 is a detailed side elevation view depicting the fabric transport tube and the plaiting mechanism including details of the outlet nozzle used in accordance with the present invention.
FIG. 4 is a front schematic taken substantially along the line 4—4 in FIG. 2 and depicting the general pattern of deposition of the fabric in the liquid treatment chamber.

In accordance with one aspect of this invention, and as shown particularly in FIG. 3, the fabric transport tube 11 defines a generally horizontal centerline C (FIG. 3). In addition, the transport tube 11 is preferably downwardly inclined in the region between the entry to the fabric transport tube 16 at the first peripheral liquor sprayer 3 and then upwardly inclined beginning near the midpoint of the fabric transport tube 20. In this manner, a first transport zone is defined commencing at the fabric inlet to the fabric transport tube 16 where the first peripheral liquor sprayer 3 is positioned, and then extending at a generally downward mild incline to the approximate midpoint 20 of the fabric transport tube 11 whereupon a second transport zone intersects the first transport zone at the lowermost point in the fabric transport tube and then extends at a gentle slope upwardly at an incline to the outlet of the fabric transport tube defined by the means mounting the plaiter mechanism 5.

In accordance with one preferred embodiment, the fabric transport tube will have a shallow v-shaped outline in profile. In this manner, the fabric transport tube 11 will be flooded with dye liquor to improve the liquor fabric interchange within the fabric transport tube, but without significantly impeding the progress of the fabric through the transport tube. In addition, this design creates a slight turbulence which tends to rearrange the fabric folds leaving the first transport zone prior to treatment in the second peripheral liquor sprayer 4.

The effective pressures at the nozzles of the peripheral liquor sprayers 3 and 4 may be varied in accordance with the invention, but will typically range from 0.1 to 0.5 bar which will correspondingly affect the speed of travel for the fabric 1 through the fabric transport tube 11. For example, in the arrangement as particularly depicted in detail in FIG. 3, the rate of travel for the fabric attainable with this arrangement is approximately 110 meters per minute at 0.10 bar inlet pressure and rises to a rate of approximate 240 meters per minute at a corresponding water pressure of 0.40 bar at the peripheral liquor sprayers 3 and 4. The angle defined by the interior diameter of the fabric transport tube and the sidewall of the nozzle within the peripheral liquor sprayer may also be varied but as shown is approximately 30 degrees.

The included angle defined between the two sections of the fabric transport tube at the midpoint 20 also may be varied, but will preferably fall in the range from about 110 to about 180 degrees and preferably in the range from about 130 to 160 degrees to define the slight "v" shape in profile. As shown in FIG. 3, the particular preferred arrangement defines an included angle of about 150 degrees at the midpoint 20 which is the junction between the first transport section and the second transport section.

The overall length of the fabric transport tube 11 also may be varied as may be the approximate length of the first and second transport zones defined by the fabric transport tube. For example the length of the first transport zone which is defined by the distance from the entry point 16 to the fabric transport tube 11 to the approximate midpoint 20 may vary in the range from 200 to 800 millimeters and is approximately 500 millimeters in the particular arrangement as depicted in the drawings. The length of the second transport zone also may be varied over similar ranges and is preferably approximately the same length as the first section and at approximately the same positive angle corresponding to the negative angle applied in the first transport zone, so that the outlet of the fabric transport tube at the plaiting mechanism 7 at the bearing 5 will lie at approximately the same elevation as the entry point 16 at the first peripheral liquor sprayer 3.

In accordance with the invention, a plaiting mechanism 7 is provided. The curved plaiter 7 directs the fabric vertically downwardly into the liquid treatment chamber or storage chamber 10 (FIG. 1). The curved plaiter 7 is preferably of rectangular cross-section throughout its length and may be a square. The base of the plaiter is preferably mounted on a circular bearing 5 at the exit end of the fabric transport tube and preferably comprises a stainless steel spherical ball roller bearing 5 which is rotatably fixed to the end of the fabric transport tube. In this manner, the entire plaiting mechanism 7 may be oscillated rapidly about the centerline of the transport tube C. The plaiter 7 defines an outlet nozzle 15 which extends downwardly into fluid communicating relationship with the inlet to the liquid treatment chamber 10. As noted, the plaiting mechanism is mounted on a circular bearing 5 about which it may be oscillated in known fashion through the reciprocating action of oscillation means 6. The plaiter may be oscillated at rates ranging from 10 to 50 complete strokes per minute and travels in a path which preferably defines a straight line across the complete width of the inlet to the liquid treatment chamber.

In accordance with a preferred embodiment of the invention, the outlet nozzle 15 defined by the plaiter 7 is oriented approximately 90 degrees to the chamber centerline and is also substantially perpendicular to the longitudinal axis or centerline C of the fabric transport tube 11. If the tube 11 is substantially straight then the angle defined between the centerline C and the nozzle 15 will be around approximately 90 degrees. Since the centerline C of the transport tube 11 may vary in its geometry from a straight line, the exact angle may vary and it is only important that the outlet nozzle 15 is downwardly directed and reciprocates along a generally linear path of travel which is transverse to the centerline and such that the fabric material 1 passing through the transport tube 11 is deposited in the inlet of the liquid treatment chamber in overlying relatively straight folds. For example, where the shallow v-shaped profile of the transport tube is employed as illustrated, the angle defined between the second transport zone defining a portion of the centerline C and the outlet nozzle 15 will be less than about 90 degrees. In this manner, the path of travel of the nozzle 15 will be a straight line across the width of the storage chamber 10.

The jet dyeing apparatus also includes a liquor bypass 8 in the plaiter assembly 7 which includes a bypass nozzle 9 which preferably communicates with the storage chamber through a path which is longitudinally spaced apart from the main path of travel of the fabric entering the storage chamber 10. In this manner, the water under pressure will tend to follow a straight line while the weight of the fabric facilitates its deflection into the liquid treatment chamber. This ensures that the liquor which is allowed to escape through the bypass nozzle 9 will not disturb the plaiting operation occurring within the treatment chamber 10.

Up to this point the elements of the jet dyeing apparatus which have been described are commonly disclosed in prior EPO Application No. 91909184.3 and U.S. Pat. No. 5,299,339. As noted previously, since these elements may also be used advantageously in accordance with the present invention, the description and drawings depicting the particular elements of the peripheral liquor sprayers and the transport tube, for example, are re-presented here. These elements are also reproduced in FIG. 5 of the present application and have been assigned corresponding reference numbers so that the plaiter assembly 7, for example, has been assigned reference character 107 in FIG. 5, the bypass nozzle 9 has been assigned reference character 109, etc.

Figures 5, 6:
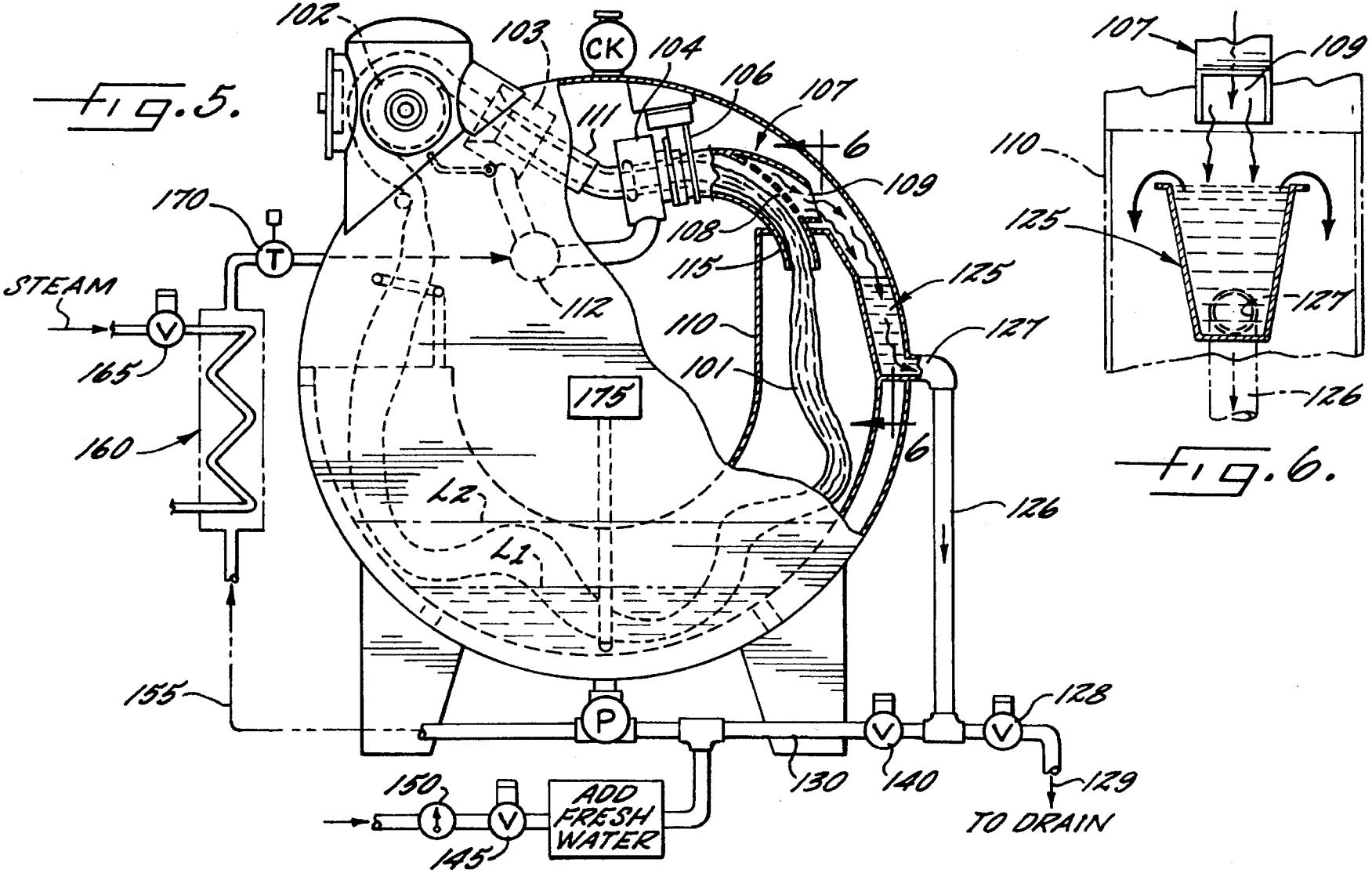
FIG. 5 is a side schematic view depicting the preferred arrangement for practicing the present invention.
FIG. 6 is a detailed front elevation view taken along the line 6—6 of FIG. 5 particularly depicting the trough assembly for removing a portion of the liquor from the interior of the dyeing apparatus to the drain/header assembly.

In accordance with applicant's prior disclosure, the liquor flowing through the liquor bypass 8 was allowed to re-enter the storage chamber 10 as depicted in FIG. 1. In accordance with the present invention, however, these flows are used advantageously as part of an improved jet dyeing apparatus and dyeing method as described further hereinbelow In the improved jet dyeing apparatus of the present invention as depicted in FIGS. 5 and 6, the liquor flowing through the liquor bypass 108 and through the bypass nozzle 109 are diverted to a trough 125. The trough is in liquid communicating relationship with a drain/header line 126 through a bypass line 127. In turn, the drain/header line 126 includes a return line 130 to the inlet side of the main recirculating pump P. The flow rates from the drain header line 126 to the inlet side of the pump may be controlled by a variable control valve 140, which may in turn be controlled by a microprocessor (not shown). In addition, an additional valve 128, which is also preferably a variable control valve monitored and controlled by the same microprocessor, may be actuated to direct a portion of the flows through the drain header line 126 directly to drain 129 during the rinse cycle as discussed at greater length below.

In accordance with the present invention, provision is also made for the addition of fresh water to the main header 112 which feeds the peripheral liquor sprayers 103, 104. More particularly, fresh water may be introduced through valve 145, preferably on the suction side of the main recirculating pump P. The actual volume of fresh water introduced is preferably controlled by an additional variable automatic control valve 145 and the flows monitored by the use of flow meter 150, both of which are preferably integrated with the microprocessor controlling valve 140 and 128 to monitor and control the relative volumes of fresh water addition in relation to the rate of waste liquor removal through drain 129 as also described further below.

The fresh water added through valve 145 is preferably heated to improve the efficiency of the rinse cycle, and preferably at temperatures in excess of 80° C. For this purpose, heat exchanger 160 is provided, which includes steam inlet valve 165 to control flow rates of steam into the exchanger and to indirectly control the temperature of the liquor/rinse water, both from the standpoint of heating the liquid to the desired temperature or, alternatively, to cool the temperature of the liquor/rinse water depending upon the stage of the overall dyeing cycle. The temperature of the liquid is preferably monitored by temperature probe 170 which also provides an input signal to the microprocessor and which, in turn, regulates the flow of steam through valve 165 according to the desired process parameters. The precise parameters will, of course, vary depending upon the nature of the fabric to be dyed, the type of dye used, and other variables, which may be selected by the fabric processor.

In order to enhance the efficiencies of the rinse cycle and, in turn, favorably influence the overall time required to complete the dyeing process, it is desirable to maintain as low a level in the liquid treatment chamber 110, as is reasonably possible during the rinse cycle. Accordingly, an analog level sensor 175 is provided in order to monitor the liquor levels in the liquid treatment chamber and which provides an operating signal to the microprocessor controlling valves 128, 140, 145, and 165.

While it is preferred to maintain the liquid level in the treatment chamber at a minimum to improve the efficiency of the rinse cycle, substantial reductions in the level of the liquid in the treatment chamber may cause cavitation of the main recirculating pump P. This in turn reduces the overall efficiency of the process. In accordance with the preferred embodiment depicted in FIG. 5, the provision of the drain header and valve 140 provides a constant head for main recirculating pump P in order to avoid cavitation problems despite the relatively low liquor levels which may be employed in the process. In addition, trough 125 is preferably positioned at substantially the same height as header 112 in order to further enhance the efficiency of main recirculating pump P, and specifically by increasing the static head on the pump. By these techniques, the liquid level in the treatment chamber 110 may be reduced from level L2 during the dyeing cycle to level L1 during the rinsing cycle.

In actual operation, the effective liquor level in the treatment chamber is reduced by opening valve 128 to drain 129 to gradually draw down the liquor level in the treatment chamber 110 as monitored by sensor 175. As the desired level is reached, valve 145 is then opened to introduce fresh water, and preferably at approximately the same rate as is concurrently being discharged through valve 128 drain 129. In order to gain maximum benefit in both time and water consumption, the flow rate of the fresh rinse water through valve 45 as monitored by flow meter 150, is maintained at approximately 10–16% of the main flow rate in the fabric transport tube 111. For example, for representative flow rates in the transport tube in the region of 700 to 1,000 litres/minute, the appropriate flow rate of the fresh water through valve 145 is approximately 60–100 litres/minute per chamber so that the fabric is continuously surrounded by from 10 to 6 % of totally fresh water during the rinse cycle. This ensures steady washing conditions which shorten both the overall cycle while minimizing overall water consumption. In addition, and as noted a portion of the contaminated liquor will be concurrently removed through valve 128 to drain 29 so that a high efficiency rinse cycle is accomplished without having to stop the main recirculating pump, drain the entire dyeing apparatus, and then refill the apparatus accomplish effective rinsing.

It has been found in preliminary trials that a complete rinsing cycle of approximately 200 minutes nay be reduced to as little as 120 minutes with a wash fastness to the same standard. In addition, the volumes of water consumed in litres was reduced from approximately 10,000 litres for the complete dyeing cycle to just under 7,000 litres, or a reduction of approximately 30% in total water consumption through the use of the apparatus and method disclosed herein.

Obviously, the potential savings from the use of the present apparatus and method will be of extreme significance and importance to fabric processors since it enables substantially increased production using comparable numbers of jet dyeing apparatuses, but while reducing overall water consumption at the same time.

In the foregoing description and accompanying drawings, there have been disclosed typical preferred embodiments of the invention and, although specific terms are employed, they are used in a generic and descriptive sense only and not for purposes of limitation, the scope of the invention being set forth in the following claims.

That which is claimed is:

1. A jet dyeing apparatus of the type used in dyeing textile materials in rope form comprising a housing, a liquid treatment chamber positioned in the lower portion of said housing and having an upwardly open inlet and an upwardly open outlet, a fabric transport tube positioned in said housing above the liquid treatment chamber comprising a generally elongate tubular member having an inlet and an outlet, and defining a path of travel for receiving and transporting a fabric article in rope form therethrough, at least one liquid application jet positioned along said fabric transport tube for applying pressurized liquid to the fabric within the fabric transport tube so as to dye the fabric and advance the fabric along the path of travel defined by the fabric transport tube, a recirculating pump for recirculating liquid from the liquid treatment chamber to the liquid application jet, a plaiting member mounted to the exit end of the transport tube for relative rotation about the transport tube, said plaiting member including an outlet nozzle for depositing the treated fabric into the liquid treatment chamber, liquid bypass means for diverting a portion of the liquid flowing through the fabric transport tube and the plaiting member outside the primary path of travel of the fabric as the fabric is deposited by the outlet nozzle into the liquid treatment chamber, a header in fluid communicating relation with said portion of the liquid flowing through said liquid bypass means for removing a portion of the liquid from the interior of said housing, said header line further being in fluid communicating relationship with said recirculating pump and with a drain assembly.

2. A jet dyeing apparatus according to claim 1 further comprising a fresh water inlet for introducing fresh water to said at least one liquid application jet during a rinse cycle.

3. A jet dyeing apparatus according to claim 2 further comprising a heat exchanger between said fresh water inlet and the liquid application jet and steam inlet control means for regulating the temperature of the liquid circulated to the liquid application jet.

4. A jet dyeing apparatus according to claim 2 further comprising fresh water inlet valve means in association with said fresh water inlet for regulating the rate of fresh water introduced to said recirculating line.

5. A jet dyeing apparatus according to claim 4 further comprising drain valve means for regulating the rate of liquid discharged through said drain assembly and control means for monitoring and adjusting the rate of discharge through said drain valve means in relation to the volumes of liquid introduced through said fresh water inlet valve.

6. A jet dyeing apparatus according to claim 5 further comprising liquid level monitoring means in said liquid treatment chamber and wherein said control means actuates the fresh water inlet valve in response to a signal from said liquid level monitoring means.

7. A jet dyeing apparatus according to claim 1 further comprising a trough in fluid communicating relationship with said liquor bypass means and said exterior header and wherein said trough is positioned at substantially the same height as said liquid application jet.

8. A method of dyeing and rinsing a fabric article in continuous rope form within a jet dyeing apparatus of the type which includes a liquid treatment chamber positioned within a housing, a fabric transport tube positioned in the housing above the liquid treatment chamber, a liquid application jet positioned along the length of the fabric transport tube for applying pressurized liquid dye to the fabric as it is conveyed through the transport tube, a recirculating pump for recirculating liquid from the liquid treatment chamber to said liquid application jet, and a discharge nozzle for depositing the fabric conveyed through the transport tube into the liquid treatment chamber, said method comprising the steps of treating the fabric in said housing with dye liquor, introducing fresh water to said liquid application jet in order to rinse the treated fabric within the fabric transport tube as it is conveyed therethrough, diverting a portion of the excess rinse liquid from the discharge nozzle to an exterior header and returning at least a portion of the diverted rinse liquid in said header to the inlet of said recirculating pump.

9. A method according to claim 8 further comprising the step of draining a portion of the rinse liquid diverted to said exterior header.

10. A method according to claim 8 wherein the liquid level in the liquid treatment chamber is reduced prior to the introduction of fresh water to said liquid application jet during a rinse cycle and wherein the relatively lower level is maintained during the rinse cycle.

11. A method according to claim 9 or 10 wherein the volume of fresh water introduced to said liquid application jet during a rinse cycle is substantially the same as the volume of the liquid portion drained from said exterior header.

* * * * *

UNITED STATES PATENT AND TRADEMARK OFFICE

CERTIFICATE OF CORRECTION

PATENT NO. : 5,621,937

DATED : April 22, 1997

INVENTOR(S) : Aristides Georgantas

It is certified that error appears in the above-identified patent and that said Letters Patent is hereby corrected as shown below:

Col. 3, line 14, insert --.-- before "The".

Col. 3, line 28, insert --.-- before "Subsequently".

Col. 3, line 33, insert --.-- before "The".

Col. 3, line 37, insert --.-- before "Therefore".

Col. 9, line 15, insert --to-- before "drain".

Col. 9, line 18, delete reference number "45" and insert --145--.

Col. 9, line 26, delete "6%" and insert --16%--.

Col. 9, line 29, insert --,-- after "noted".

Col. 9, line 31, delete reference number "29" and insert --129--.

Signed and Sealed this

Tenth Day of February, 1998

Bruce Lehman

*Attest:*

BRUCE LEHMAN

*Attesting Officer*

*Commissioner of Patents and Trademarks*